US010315879B2

(12) United States Patent
Harano

(10) Patent No.: US 10,315,879 B2
(45) Date of Patent: Jun. 11, 2019

(54) SHEET PROCESSING APPARATUS, CONTROL METHOD THEREFOR AND STORAGE MEDIUM

(71) Applicant: CANON KABUSHIKI KAISHA, Tokyo (JP)

(72) Inventor: Yuzo Harano, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/058,833

(22) Filed: Oct. 21, 2013

(65) Prior Publication Data

US 2014/0125006 A1 May 8, 2014

(30) Foreign Application Priority Data

Nov. 5, 2012 (JP) ..... 2012-243849

(51) Int. Cl.
*B65H 29/60* (2006.01)
*B65H 31/40* (2006.01)
(Continued)

(52) U.S. Cl.
CPC ..... *B65H 31/40* (2013.01); *B65H 29/60* (2013.01); *B65H 31/10* (2013.01); *B65H 31/20* (2013.01);
(Continued)

(58) Field of Classification Search
CPC ..... B65H 29/58; B65H 29/60; B65H 29/64; B65H 31/00; B65H 31/24; B65H 31/40; B65H 33/14; B65H 43/00; B65H 43/04; B65H 2511/10; B65H 2511/12; B65H 2701/1131; B65H 2301/16; B65H 2301/211; B65H 2301/13; B65H 2301/131; B65H 2301/14; B65H 2301/141
See application file for complete search history.

(56) References Cited

U.S. PATENT DOCUMENTS

2008/0054557 A1* 3/2008 Hayashi et al. ..... 271/279
2008/0054558 A1* 3/2008 Obuchi et al. ..... 271/298
2010/0161112 A1* 6/2010 Kurakata ..... 700/217

FOREIGN PATENT DOCUMENTS

CN 1305428 A 7/2001
CN 1480341 A 3/2004
(Continued)

OTHER PUBLICATIONS

Machine translation of JP 2008-162753.*
(Continued)

*Primary Examiner* — Thomas A Morrison
(74) *Attorney, Agent, or Firm* — Cowan, Liebowitz & Latman, P.C.

(57) ABSTRACT

A sheet processing apparatus of an aspect of the present invention includes stack trays provided with alignment members for applying an alignment process to sheets. At the time of discharging sheets, in a case where a sheet is already stacked on a first stack tray that has been decided on as a discharge destination for a sheet to be discharged, the sheet processing apparatus determines whether or not the width of the sheet to be discharged matches the width of the already-stacked sheet. In a case where the widths of the sheets do not match, a discharge destination for the sheet to be discharged is changed to a second stack tray.

14 Claims, 9 Drawing Sheets

(51) Int. Cl.

| | |
|---|---|
| ***B65H 31/20*** | (2006.01) |
| ***B65H 31/24*** | (2006.01) |
| ***B65H 31/38*** | (2006.01) |
| ***B65H 43/00*** | (2006.01) |
| ***G03G 15/00*** | (2006.01) |
| ***B65H 31/10*** | (2006.01) |

(52) U.S. Cl.

CPC ..... *B65H 31/24* (2013.01); *B65H 31/38* (2013.01); *B65H 43/00* (2013.01); *G03G 15/6502* (2013.01); *B65H 2405/332* (2013.01); *B65H 2511/12* (2013.01); *B65H 2513/42* (2013.01); *B65H 2801/27* (2013.01); *G03G 2215/00561* (2013.01)

(56) References Cited

FOREIGN PATENT DOCUMENTS

| | | | | |
|---|---|---|---|---|
| CN | 101016126 | A | | 8/2007 |
| CN | 101024345 | A | | 8/2007 |
| JP | 2003-274065 | | * | 9/2003 |
| JP | 2006-193325 | A | | 7/2006 |
| JP | 2006-206331 | A | | 8/2006 |
| JP | 2007-099463 | A | | 4/2007 |
| JP | 2008-162753 | | * | 7/2008 |
| JP | 2010-143718 | A | | 7/2010 |
| JP | 2010-222079 | A | | 10/2010 |
| JP | 2011-194851 | A | | 10/2011 |

OTHER PUBLICATIONS

Feb. 28, 2014 Partial European Search Report which is enclosed of the counterpart European Patent Application No. 13188840.6.

Jul. 3, 2015 Chinese Office Action, which is enclosed with an English Translation, that issued in Chinese Patent Application No. 201310538067.6.

Nov. 17, 2015 Korean Office Action, which is enclosed without an English Translation, that issued in Korean Patent Application No. 10-2013-0132679.

Sep. 9, 2016 Japanese Office Action, which is enclosed without an English Translation, that issued in Japanese Patent Application No. 2012243849.

* cited by examiner

SHEET PROCESSING APPARATUS, CONTROL METHOD THEREFOR AND STORAGE MEDIUM

BACKGROUND OF THE INVENTION

Field of the Invention

The present invention relates to a sheet processing apparatus that has a function of aligning sheets stacked on a stack tray, and a control method for the sheet processing apparatus, and a storage medium.

Description of the Related Art

For sheet processing apparatuses that stack a large number of sheets, there has been demand for the ability to discharge and align the sheets with a high degree of accuracy. Japanese Patent Laid-Open No. 2006-206331 suggests a sheet alignment process in which alignment members (alignment mechanisms) are provided on a stack tray, and sheets are piled up in such a manner that the positions of edge surfaces of the sheets parallel to a sheet discharge direction are lined up by the alignment members coming into and out of contact with the edge surfaces of the sheets.

However, this conventional technique has the following problem. For example, when applying an alignment process to sheets newly stacked on printed materials (sheets) that are already stacked on a stack tray and have a different width from the newly-stacked sheets, the toner or ink on the already-stacked sheets could possibly be removed by the above alignment mechanisms coming into contact with the already-stacked sheets. This may lead to a reduction in the image quality of the printed materials.

SUMMARY OF THE INVENTION

The present invention has been made in view of the above problem. The present invention provides a technique to execute a sheet alignment process on a sheet processing apparatus and to maintain the image quality of sheets.

According to one aspect of the present invention, there is provided a sheet processing apparatus comprising: a first stack tray and, at least, a second stack tray on which a sheet is stacked; an alignment unit including, at least, an alignment member provided on the first stack tray, which is configured to align sheets stacked on the first stack tray by coming into contact with side surfaces of the stacked sheet; a determination unit configured, in a case where a second sheet is already stacked on the first stack tray that has been decided on as a discharge destination for a first sheet, to determine whether or not the width of the first sheet matches the width of the second sheet; and a control unit configured, in a case where the determination unit determines that the width of the first sheet does not match the width of the second sheet, to control the sheet processing apparatus not to discharge the first sheet to the first stack tray.

According to another aspect of the present invention, there is provided a control method for a sheet processing apparatus including a first stack tray and a second stack tray on which a sheet is stacked and an alignment unit including an alignment member that is provided on the first stack tray and aligns sheets stacked on the first stack tray by coming into contact with side surfaces of the stacked sheet, the control method comprising the steps of: determining, in a case where a second sheet is already stacked on the first stack tray that has been decided on as a discharge destination for a first sheet, whether or not a width of the first sheet matches a width of the second sheet; and performing, in a case where it is determined that the width of the first sheet does not match the width of the second sheets, control of the sheet processing apparatus not to discharge the first sheet to the first stack tray.

According to still another aspect of the present invention, there is provided a computer-readable storage medium storing a program that, when executed by a sheet processing apparatus including a first stack tray and a second stack tray on which a sheet is stacked and an alignment unit including an alignment member that is provided on the first stack tray and aligns sheets stacked on the first stack tray by coming into contact with side surfaces of the stacked sheet, causes the sheet processing apparatus to perform a control method comprising the steps of: determining, in a case where a second sheet is already stacked on the first stack tray that has been decided on as a discharge destination for a first sheet, whether or not a width of the first sheet matches a width of the second sheet; and performing, in a case where it is determined that the width of the first sheet does not match the width of the second sheets, control of the sheet processing apparatus not to discharge the first sheet to the first stack tray.

The present invention can provide a technique to execute a sheet alignment process on a sheet processing apparatus without interrupting a sheet process while maintaining the image quality of sheets.

Further features of the present invention will become apparent from the following description of embodiments (with reference to the attached drawings). Each of the embodiments of the present invention described below can be implemented solely or as a combination of a plurality of the embodiments or features thereof where necessary or where the combination of elements or features from individual embodiments in a single embodiment is beneficial.

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

First Embodiment

<Configuration of Printing System 100>

Figure 1:
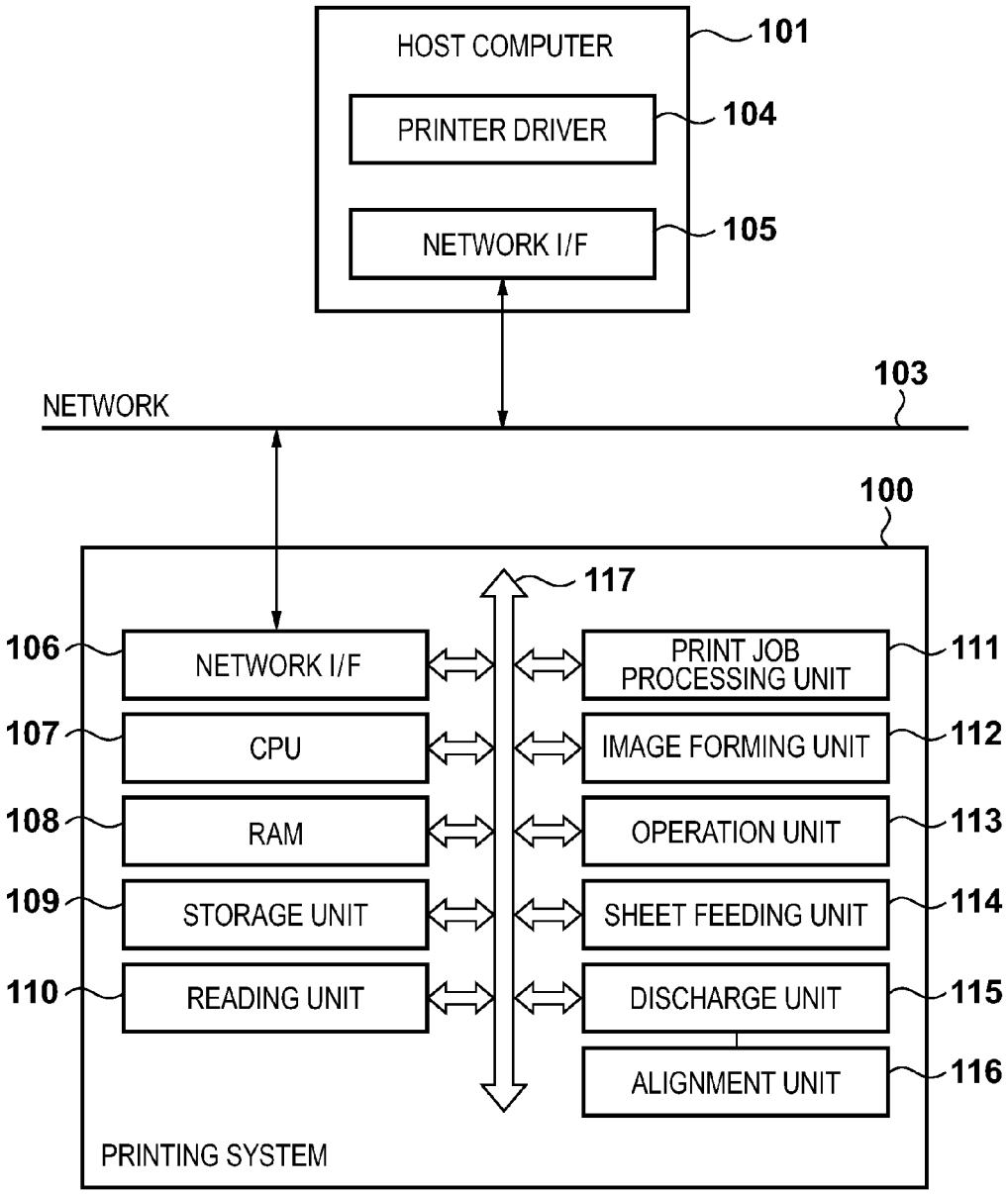
FIG. 1 is a block diagram showing a configuration of a network including a printing system 100 and a host computer 101 according to the first and second embodiments.
Figure 2:
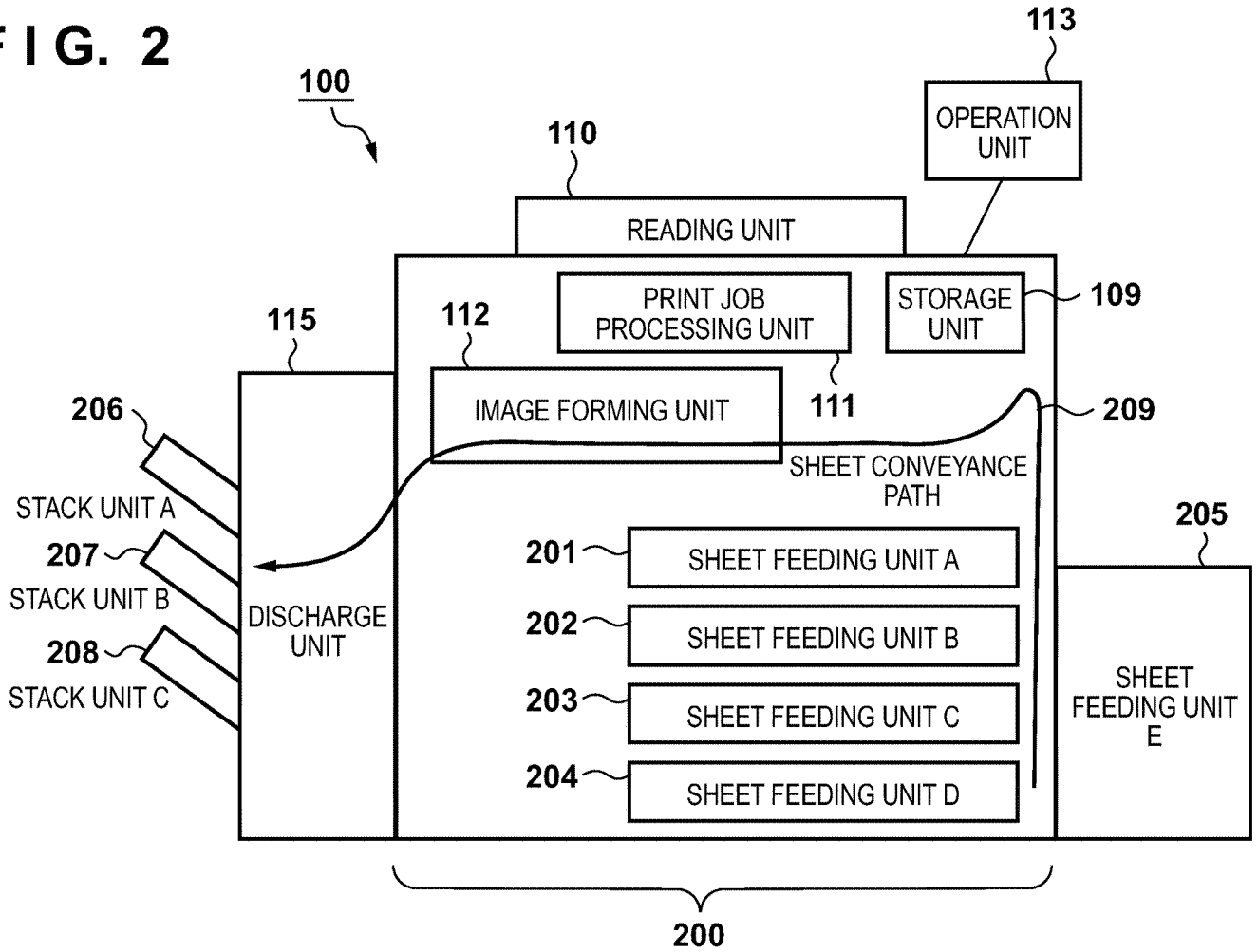
FIG. 2 shows a configuration of the printing system 100 according to the first and second embodiments.

The following describes a configuration of a network according to the first embodiment of the present invention with reference to FIGS. 1 and 2. As shown in FIG. 1, a printing system 100 is connected to a host computer 101 via a network 103. The printing system 100 can communicate with external apparatuses such as the host computer 101 connected to the network 103. Examples of the network 103 include a local area network (LAN), a wide area network (WAN), and a telephone line network.

As shown in FIG. 2, the printing system 100 includes a printing apparatus 200, a discharge unit 115 that is a sheet stacker, and a sheet feeding unit 205 (sheet feeding unit E). The present embodiment describes an example where a sheet processing apparatus of the present invention is applied to a printing system in which the discharge unit 115 and the sheet feeding unit 205 are attached to the printing apparatus 200. It should be noted, however, that the present invention is not limited in this way, and is applicable to any sheet processing apparatus with a mechanism for discharging and stacking sheets. That is to say, not only the printing system 100 but also the printing apparatus 200 and the discharge unit (sheet stacker) 115 can each serve as an example of the sheet processing apparatus.

In the present embodiment, it is assumed that the host computer 101 is a PC (personal computer). In general, the host computer 101 (PC) includes a CPU (central processing unit), an HDD (hard disk drive), a RAM (random-access memory), various types of input/output apparatuses, and the like. The host computer 101 also includes a network I/F 105, and is connected to the network 103 via the network I/F 105. The network I/F 105 performs communication control for establishing connection and communicating with external apparatuses via the network 103. For example, the network I/F 105 can perform the Internet communication using the Transmission Control Protocol and Internet Protocol (TCP/IP), and transmit/receive data to/from the printing system 100.

A printer driver 104 is installed in the host computer 101. The printer driver 104 is software that runs on an operating system (OS) for controlling the host computer 101. In accordance with a print instruction from an application running on the OS, the printer driver 104 generates a print job in which print data is represented using a page description language (PDL), and transmits the generated print job to the printing system 100.

The printing system 100 includes a network I/F 106, a CPU 107, a RAM 108, a storage unit 109, a reading unit 110, a print job processing unit 111, an image forming unit 112, an operation unit 113, a sheet feeding unit 114, and a discharge unit 115. These units in the printing system 100 are connected to one another via a system bus 117. The discharge unit 115 has an alignment unit 116 as its subsystem. In the present embodiment, the printing system 100 is described as a multi-function peripheral (MFP) that has functions of a copier, a printer, a facsimile (FAX) machine, and the like. However, the present invention is not limited in this way. Alternatively, the printing system 100 may be a single-function peripheral (SFP) that only has a function of a printer.

The network I/F 106 is connected to and communicates with external apparatuses such as the host computer 101 via the network 103, and controls communication via the network 103. For example, the network I/F 106 can perform the Internet communication using TCP/IP, and transmit/receive data to/from the host computer 101.

The CPU 107 executes various types of calculation processing, information processing, apparatus control and the like by loading numerous programs stored in the storage unit 109 to the RAM 108 and executing the loaded programs. The RAM 108 is a general volatile storage device that can be accessed directly from the CPU 107, and is used as a working area for the CPU 107 or as a temporary data storage area. The storage unit 109, which is an HDD in the present embodiment, is used to temporarily or permanently store a print job accepted (received) from the host computer 101 via the network 103.

The reading unit 110 is a scanner that optically reads a paper original. The reading unit 110 includes an original illumination lamp and a scan mirror, and optically scans an original placed on a glass platen. Reflected light from the original is directed to a lens by the scan mirror and a reflection mirror. Light that has passed through this lens is directed to a solid-state image sensor. The light directed to the solid-state image sensor is converted into electrical signals by the solid-state image sensor and recognized as image signals. Examples of the solid-state image sensor include an image sensor using a charge-coupled device (CCD) method or a complementary metal-oxide-semiconductor (CMOS) method.

The print job processing unit 111 generates image data for printing by processing a print job such as copying, PDL and FAX, and transfers the generated image data to the later-described image forming unit 112. Note that a page description language is a language used to describe instructions for controlling a page printer. Representative examples of a page description language are PostScript (PS) and Printer Control Language (PCL). Upon receiving a print job, the print job processing unit 111 generates image data for printing by applying image processing to this image data in accordance with printing attributes of the received print job so as to convert image data included in the received print job into raster data on a per-page basis.

The image forming unit 112 is a printer engine that executes printing on a sheet based on the raster data, i.e. the image data for printing transmitted from the print job processing unit 111. The image forming unit 112 outputs a printed material by forming, on a sheet, an image based on the raster data that was generated by the print job processing unit 111 through processing of a raster image processor (RIP). While the image forming unit 112 is a printer engine that forms an image using electrophotography in the present embodiment, the image forming unit 112 may alternatively be a printer engine that forms an image using other methods such as an inkjet method.

The operation unit 113 is a user interface (UI) used to, for example, operate and set the printing apparatus. In the present embodiment, the operation unit 113 is a UI utilizing a liquid crystal display (LCD) touchscreen method.

The sheet feeding unit 114 includes a plurality of cassettes or decks that contain sheets used in the printing system 100. The sheet feeding unit to be used in feeding sheets changes depending on sheet attributes of print jobs and the settings or states of the printing system 100 itself, and the print job processing unit 111 decides which unit to use. Sheets fed from the sheet feeding unit 114 are conveyed to the image forming unit 112, and images are printed on these sheet. As a result, printed materials are generated.

The discharge unit 115 is a finisher for discharging sheets on which images have been formed (printed) by the image forming unit 112 (printed materials) to the outside of the printing system 100. The discharge unit 115 includes a plurality of stack trays as discharge destinations of sheets. The print job processing unit 111 executes discharge control as follows. After deciding on a discharge destination for sheets in accordance with attributes of a print job, the print job processing unit 111 instructs the discharge unit 115 to discharge sheets to the discharge destination that was decided on. It should be noted that the discharge unit 115 may be another discharge apparatus, such as a stacker, instead of a finisher.

The alignment unit 116 is a subsystem of the discharge unit 115, and applies an alignment process to a plurality of sheets stacked on the stack trays included in the discharge unit 115. The alignment unit 116 includes a plurality of alignment members. As will be described later, each alignment member is composed of a pair of members, and aligns a plurality of sheets stacked on a corresponding stack tray by coming into contact with (both) side surfaces of the stacked sheets parallel to a conveyance direction, with the pair of members holding the side surfaces therebetween. In this way, each alignment member aligns the plurality of stacked sheets in a bundle with their edges lined up.

The print job processing unit 111 according to the present embodiment confirms whether or not previously-discharged sheets (second sheets) are still placed on a stack tray in the discharge unit 115 that is designated as a discharge destination for sheets designated by a print job to be processed (first sheets). If sheets are still placed on the designated stack tray, the print job processing unit 111 determines whether or not the width of the designated sheets (a main scanning width that is orthogonal to the conveyance direction) matches the width of the already-stacked sheets. When the print job processing unit 111 determines that the width of the sheets designated by the print job to be processed does not match the width of the already-stacked sheets, the print job processing unit 111 changes the discharge destination for sheets to another stack tray that is included among the plurality of stack trays in the discharge unit 115 and is different from the designated stack tray. Thereafter, the print job processing unit 111 performs control to stack the sheets on the other stack tray and cause the alignment unit 116 to execute the alignment process.

A configuration of the printing system 100 is described in more detail below with reference to FIG. 2. As described above, the printing system 100 includes the printing apparatus 200 as well as the discharge unit 115 and the sheet feeding unit 205 connected to the printing apparatus 200. The printing apparatus 200 includes the storage unit 109, the reading unit 110, the print job processing unit 111, the image forming unit 112, and the operation unit 113 shown in FIG. 1.

Sheet feeding units 201 to 204 (sheet feeding units A to D) provided inside the printing apparatus 200, and the sheet feeding unit 205 (sheet feeding unit E) provided outside the printing apparatus 200, all correspond to the sheet feeding unit 114 (FIG. 1). In the present embodiment, the sheet feeding units 201 to 204 are made up of a plurality of sheet cassettes, and the sheet feeding unit 205 is made up of a sheet deck. The discharge unit 115 is provided with stack units 206 to 208 (stack units A to C) as a plurality of stack trays on which discharged sheets are stacked. A sheet conveyance path 209 represents a path along which, after print control has been started by the print job processing unit 111, sheets are fed from one of the sheet feeding units 201 to 205 and arrive at the discharge unit 115 (one of the stack units 206 to 208) via the image forming unit 112.

<Configuration of Discharge Unit 115>

Figure 3:
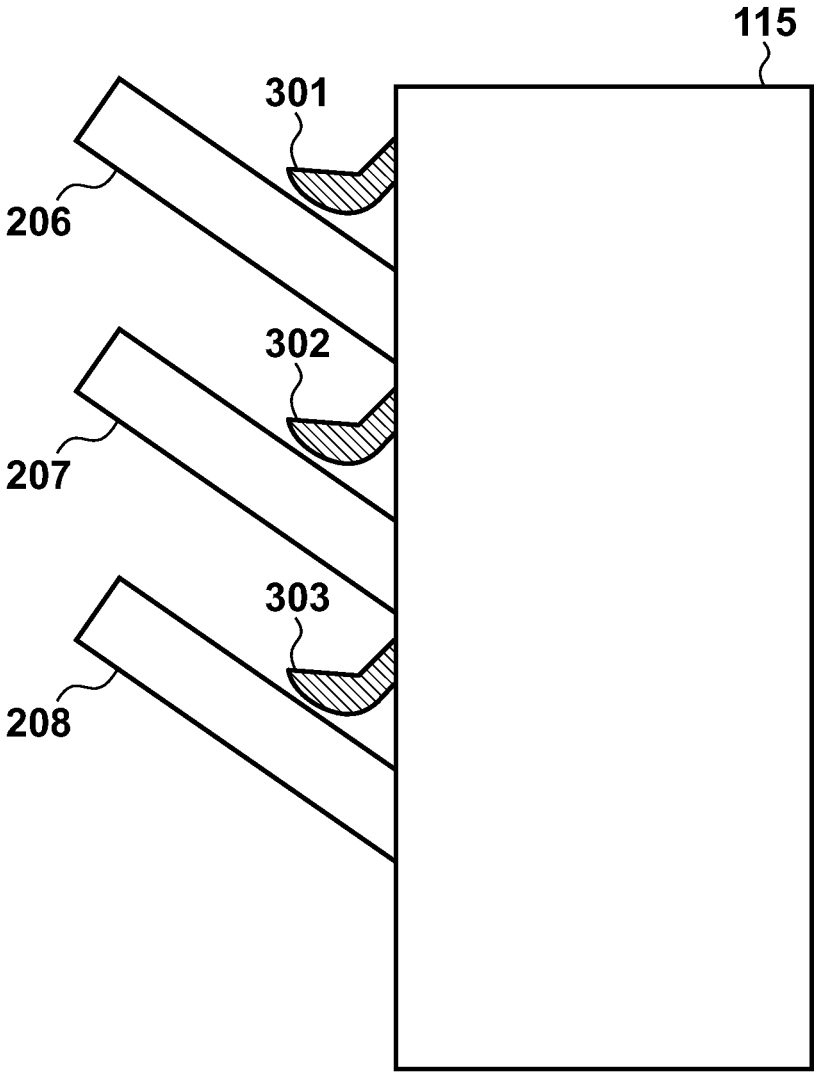
FIG. 3 is a diagram for describing the operations of a discharge unit 115 according to the first and second embodiments.

FIG. 3 shows the discharge unit 115 according to the present embodiment as viewed in a direction intersecting with the conveyance direction of sheets. As described above, the discharge unit 115 includes three stack units (stack trays), namely the stack units 206 to 208 (stack units A to C). The stack units 206 to 208 include alignment units 301 to 303 (alignment units A to C), respectively. Although the discharge unit 115 includes the stack units 206 to 208 as three stack trays in the present embodiment, the number of stack trays included in the discharge unit 115 is not limited to three, as long as the discharge unit 115 includes more than one stack trays. Alternatively, the stack units 206 to 208 may be stackers.

The discharge unit 115, which is a finisher as described above, sequentially receives sheets that have been discharged from the printing apparatus 200 via the image forming unit 112. The discharge unit 115 generates printed materials by applying various post-processes to the plurality of received sheets, such as an alignment process applied to the received sheets using the alignment units 301 to 303, a staple process for binding the received sheets using a stapler, and a punch process for creating holes in the received sheets.

The print job processing unit 111 performs discharge control for discharging sheets onto a stack tray designated by a print job, or onto a stack tray that the print job processing unit 111 has decided on at its own discretion. After print control has been started by the print job processing unit 111, sheets which have been fed from one of the sheet feeding units 201 to 205 and on which printing has been performed by the image forming unit 112 are discharged onto one of the stack units 206 to 208 through discharge control by the print job processing unit 111.

The alignment units 301 to 303 are provided in correspondence with the plurality of stack units 206 to 208, respectively, and are equivalent to the plurality of alignment members that each align sheets stacked on the corresponding stack unit by coming into contact with side surfaces of the stacked sheets parallel to the conveyance direction. As described above, each alignment member is composed of a pair of members. The alignment units 301 to 303 correspond to the alignment unit 116 (FIG. 1).

Figure 4:
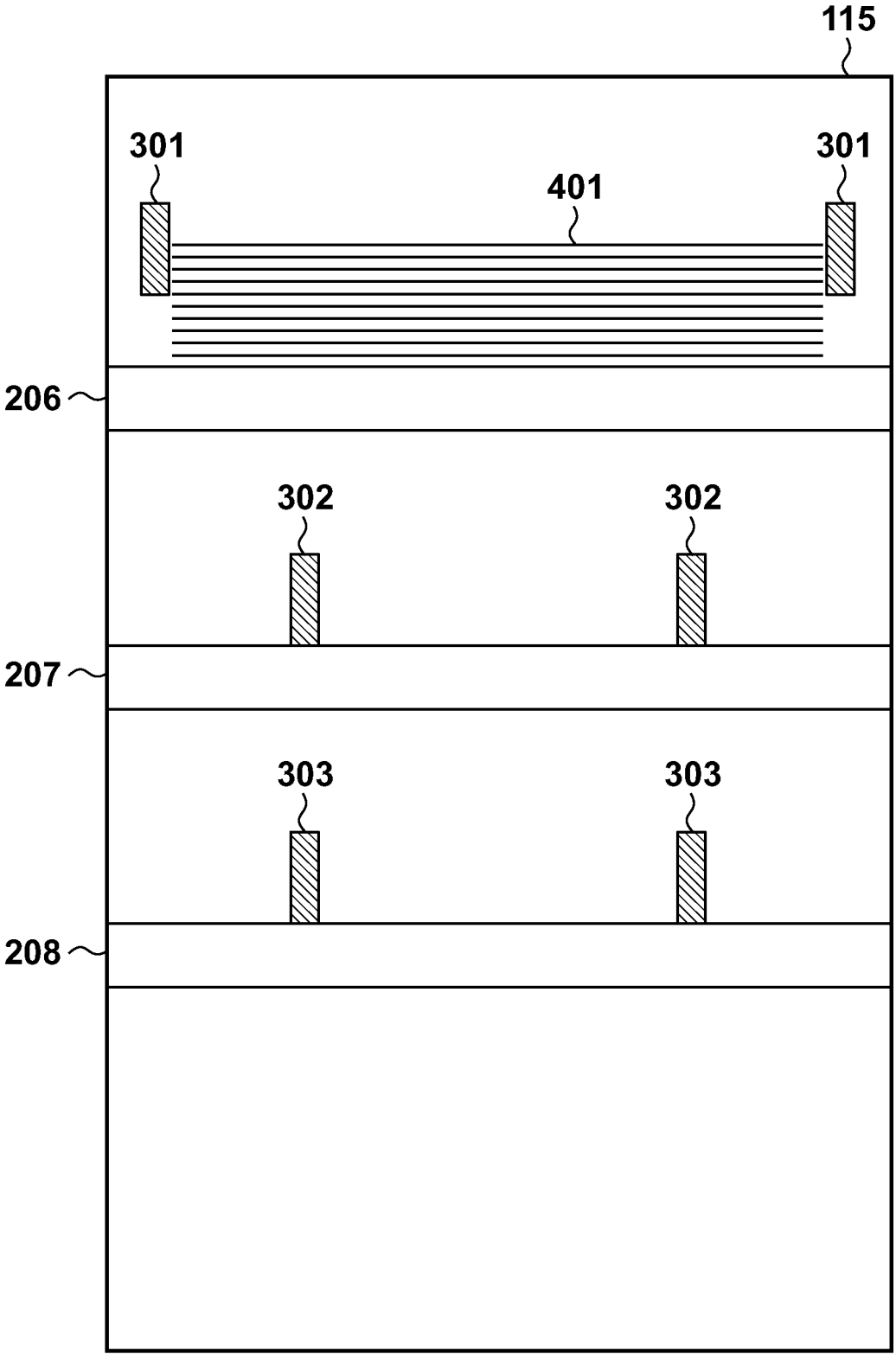
FIG. 4 is a diagram for describing the operations of the discharge unit 115 according to the first and second embodiments.

FIG. 4 shows the discharge unit 115 according to the present embodiment as viewed in a direction opposing the conveyance direction of sheets. As shown in FIG. 4, each of the alignment units (alignment members) 301 to 303 is composed of a pair of members. FIG. 4 shows an example where a plurality of sheets have been discharged and stacked on the stack unit 206 as printed materials 401.

In the state shown in FIG. 4, before the sheets are discharged, the two members of the alignment unit 301 move in a width direction orthogonal to a discharge direction of the sheets so that the interval therebetween is larger than the width of the sheets. Furthermore, after the sheets are discharged, the two members of the alignment unit 301 move toward the center of the sheets (so that the interval therebetween is reduced in the width direction orthogonal to the discharge direction of the sheets), and come into contact with both side surfaces of the plurality of stacked sheets; as a result, both edges of the plurality of stacked sheets are lined up. In the above manner, the alignment unit 301 executes an alignment process for aligning the plurality of sheets stacked on the stack unit 206.

Meanwhile, the alignment units 302 and 303, which are respectively provided in correspondence with the stack units 207 and 208 on which sheets are not stacked, wait at their respective home positions until sheets are discharged onto the corresponding stack units 207 and 208 via discharge control by the print job processing unit 111.

Figure 5:
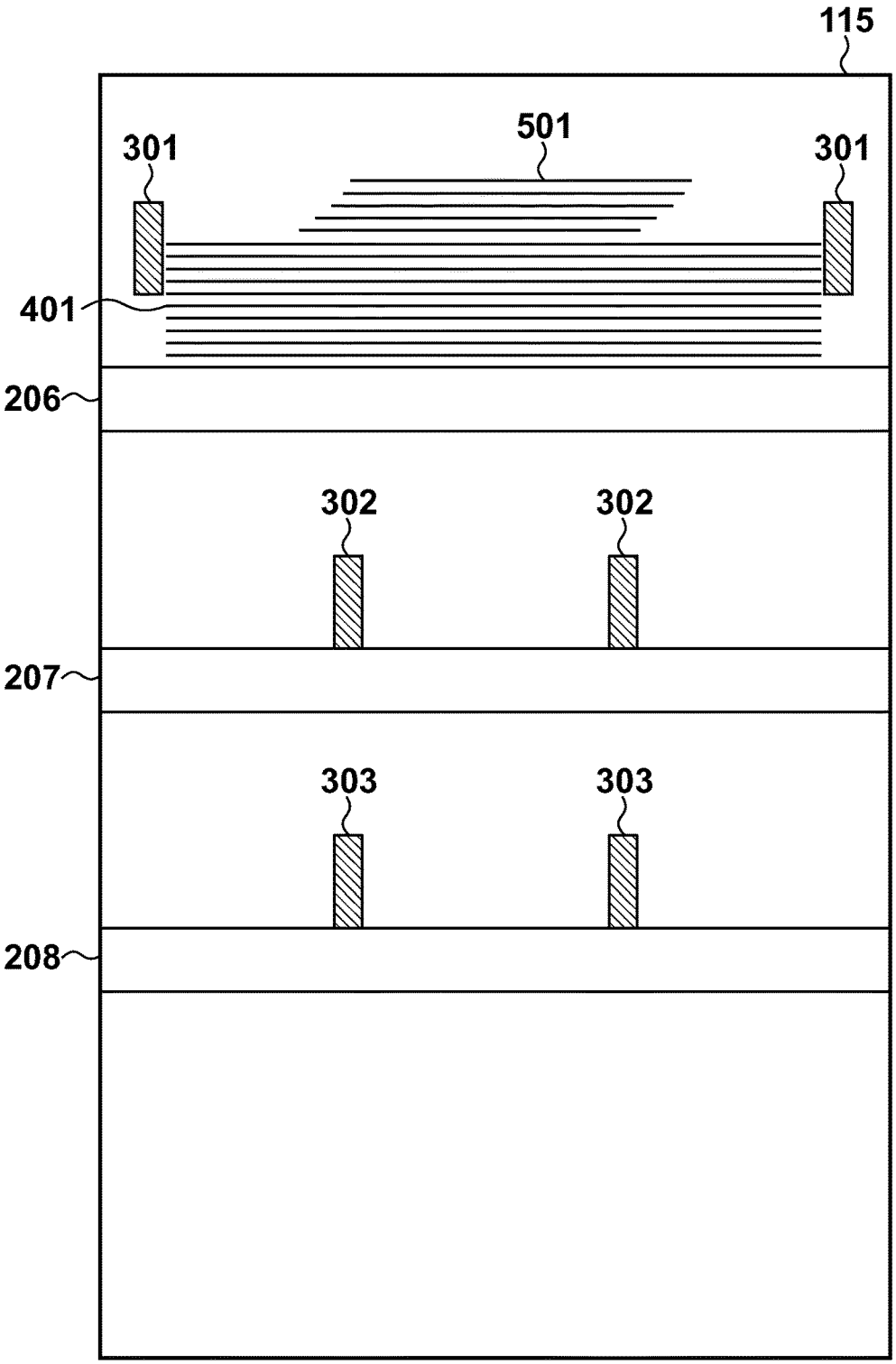
FIG. 5 is a diagram for describing the operations of the discharge unit 115 according to the first and second embodiments.

As with FIG. 4, FIG. 5 shows the discharge unit 115 according to the present embodiment as viewed in a direction opposing the conveyance direction of sheets. In FIG. 5, a plurality of sheets have been discharged and stacked as printed materials 401 on the stack unit 206. The alignment unit 301 has already applied an alignment process to the printed materials 401. Moreover, a plurality of sheets that have a smaller width than the sheets composing the printed materials 401 have been discharged and stacked as printed materials 501 on the printed materials 401.

Assume the case where the alignment unit 301 applies an alignment process to the printed materials 501 stacked on the printed materials 401. In this case, it is necessary to cause the bottom surfaces of the two members of the alignment unit 301 to come into contact with the stacked printed materials 401. When the two members of the alignment unit 301 are moved in the width direction of the sheets in this state, the two members are slid against the already-stacked printed materials 401. This gives rise to the possibility that the toner on the printed materials 401 is removed, and the removed toner attaches to the alignment unit 301 and then to a blank portion of the printed materials 401. This can lead to a reduction in the image quality of the printed materials 401.

Figure 6:
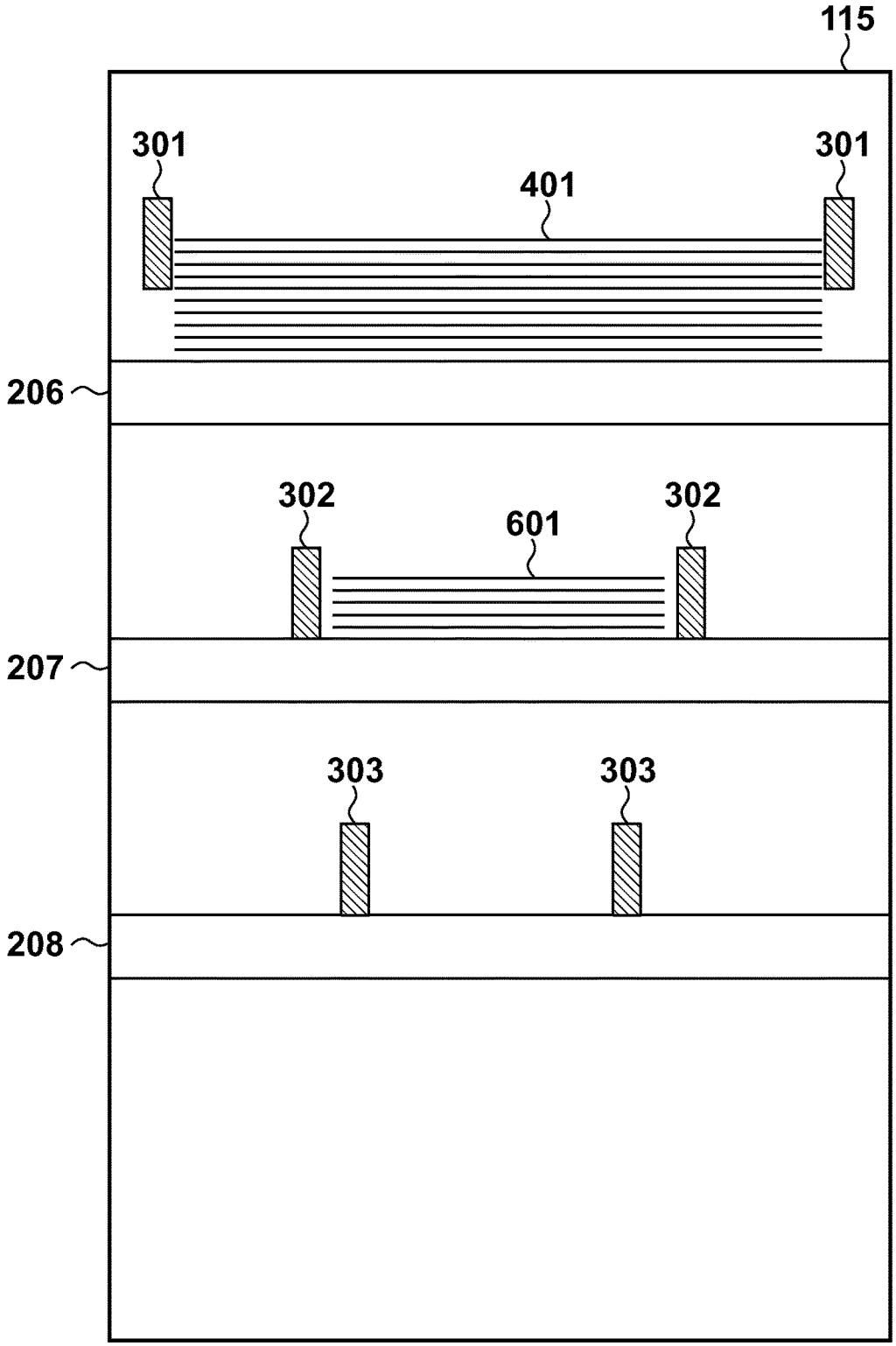
FIG. 6 is a diagram for describing the operations of the discharge unit 115 according to the first and second embodiments.

In view of the above, in the case where sheets are already stacked on a stack unit designated as a discharge destination for sheets (in the present example, the stack unit 206), the present embodiment applies discharge control and an alignment process to sheets as shown in FIG. 6. Similarly to FIGS. 4 and 5, FIG. 6 shows the discharge unit 115 according to the present embodiment as viewed in a direction opposing the conveyance direction of sheets. In FIG. 6, a plurality of sheets have been discharged and stacked as printed materials 401 on the stack unit 206. The alignment unit 301 has already applied an alignment process to the printed materials 401. It will be assumed that the stack unit 206 is designated as a discharge destination for sheets to be newly discharged.

In this case, as the printed materials 401 (second sheets) are already stacked on the designated stack unit 206 as shown in FIG. 6, the print job processing unit 111 determines whether or not the width of these printed materials 401 matches the width of the sheets to be newly discharged (first sheets). If the widths of the sheets do not match, the print job processing unit 111 changes the discharge destination for the sheets to be newly discharged to the stack unit 207 or 208 that is different from the designated stack unit 206. In the case of FIG. 6, as the width of the sheets to be newly discharged (printed materials 601) is smaller than the width of the already-stacked printed material 401, the print job processing unit 111 changes the discharge destination for the sheets to be newly discharged from the stack unit 206 to the stack unit 207.

Once the printed materials 601 have been discharged and stacked on the stack unit 207, the discharge unit 115 applies an alignment process to the stacked printed materials 601 using the alignment unit 302 that is provided in correspondence with the stack unit 207. When sheets that have a smaller width than a plurality of sheets that are already stacked on the designated stack unit 206 are to be newly discharged, the discharge destination is changed to another stack unit, and an alignment process is applied to the sheets stacked on the other stack unit. This can prevent a reduction in the image quality of the already-stacked sheets caused by the alignment process applied to the newly-stacked sheets. Furthermore, as the discharge destination for sheets is changed to another discharge destination based on the result of determination regarding the sheet widths, the stacking and alignment processes for the sheets are not interrupted, and therefore the productivity of a sheet process is not reduced.

FIG. 6 shows an example where a discharge destination for a plurality of sheets to which an alignment process is to be applied is changed from the stack unit 206 to the stack unit 207. When changing a discharge destination for a plurality of sheets, it is sufficient for the print job processing unit 111 to select, as appropriate, any of a plurality of stack units where an alignment process using the alignment members can be executed. For example, it is sufficient to decide, as a discharge destination, one of the stack units provided with the alignment units which is different from the designated stack unit and on which sheets are not currently stacked or sheets having the same width as the sheets to be discharged are currently stacked. That is to say, it is sufficient to perform control such that a stack unit on which sheets having a different width from the sheets to be discharged are stacked is not decided on as a discharge destination, even if that stack unit is different from the designated stack unit. When sheets having the same width as already-stacked sheets are newly stacked on the already-stacked sheets, the alignment unit (alignment member) does not come into contact with the front surface of the already-stacked sheets during the application of an alignment process to the newly-stacked sheets, and thus the image quality of the already-stacked sheets is not reduced.

<Procedure for Sheet Process by Printing System 100>

Figure 7:
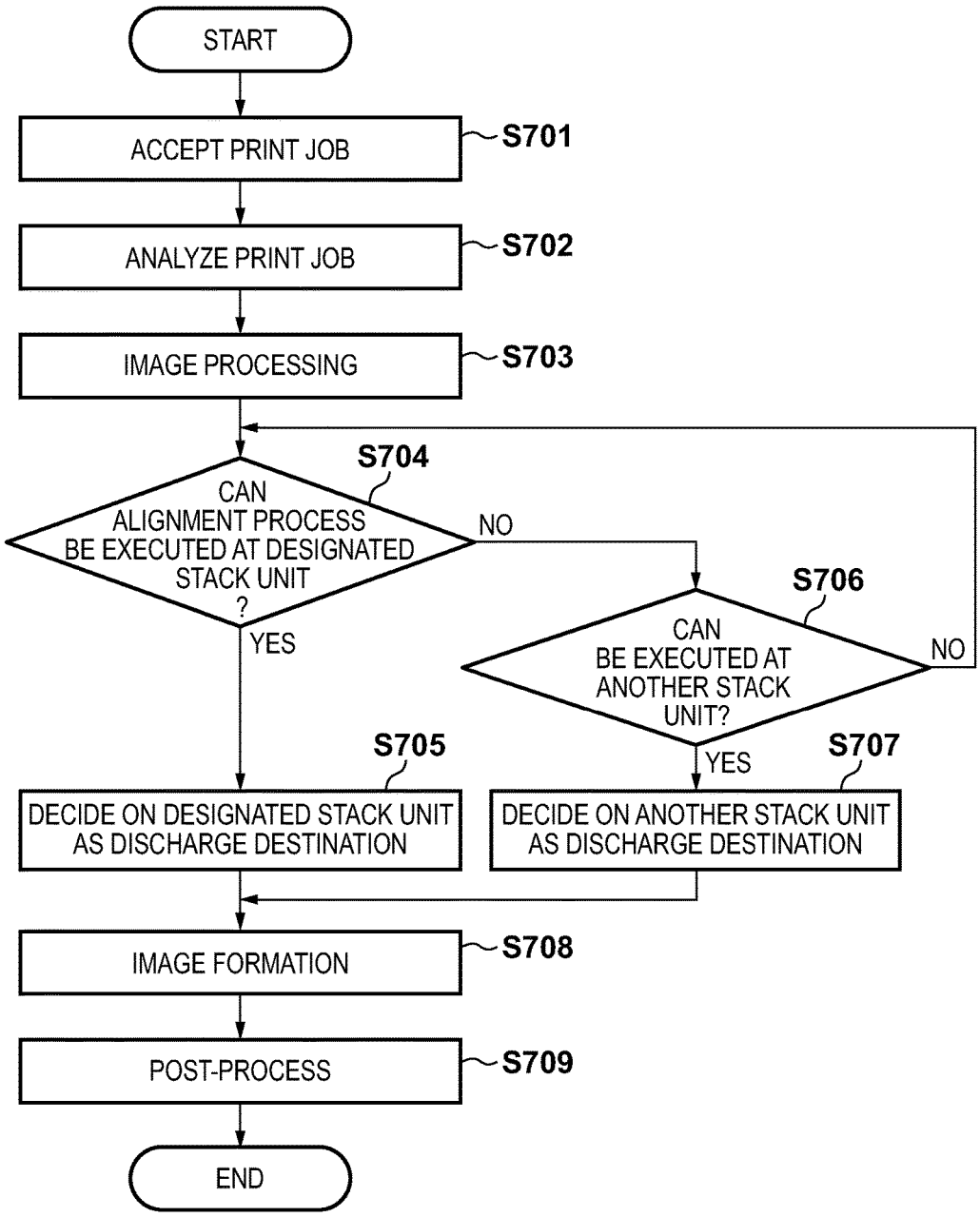
FIG. 7 is a flowchart of a procedure for a sheet process executed by the printing system 100 according to the first embodiment.

The following describes a procedure for a sheet process executed by the printing system 100 according to the present embodiment with reference to FIG. 7. It should be noted that the processes of steps in the flowchart of FIG. 7 are realized in the printing system 100 by the print job processing unit 111 reading programs stored in the storage unit 109 into the RAM 108 and executing the read programs.

First, in S701, the print job processing unit 111 executes an accepting process for accepting a print job and starts a process based on the accepted print job. Examples of the print job include a printing job transmitted from the host computer 101, a copy job executed in the printing system 100, and a FAX job transmitted from an external apparatus via the network 103 (a telephone line and the like). Another example of the print job is a stored data job for printing of data stored in the storage unit 109 in accordance with an instruction from the operation unit 113. The print job processing unit 111 temporarily spools the accepted (received) print job in the storage unit 109.

Next, in S702, the print job processing unit 111 acquires the type and the print settings of the accepted print job (in particular, discharge destination designation information that shows a designated discharge destination for sheets) by analyzing the accepted print job. When a discharge destination is not specifically designated by the accepted print job, the print job processing unit 111 may select a stack unit (stack tray) that is to serve as a discharge destination, at its own discretion, and generate the discharge destination designation information accordingly. For example, the print job processing unit 111 may select a stack unit that has been specified in advance in the printing system 100 as a discharge destination. In this case, in the later-described S704, the print job processing unit 111 executes a determination process with respect to this stack unit that has been specified in advance.

In S703 that follows S702, the print job processing unit 111 applies image processing to image data to be printed included in the accepted print job, thereby acquiring raster data to which processing of RIP has been applied. The print job processing unit 111 then proceeds to the process of S704.

In S704, the print job processing unit 111 determines whether or not an alignment process can be executed at the designated stack unit based on the discharge destination designation information acquired in S702. More specifically, as described above, when sheets are not stacked on the designated stack unit, the print job processing unit 111 determines that the alignment process can be executed at the designated stack unit. On the other hand, when sheets are already stacked on the designated stack unit, the print job processing unit 111 determines whether or not the width of the already-stacked sheets matches the width of sheets to be discharged based on the print job. Information showing whether or not sheets are already stacked on each stack unit and information showing the widths of the stacked sheets may be stored in the storage unit 109 by the print job processing unit 111 ahead of time. The print job processing unit 111 can recognize whether or not sheets are stacked on each sheet stacking unit, as well as the widths of the stacked sheets, by referring to the pieces of information stored in the storage unit 109 afterward.

When the width of the already-stacked sheets matches the width of the sheets to be discharged based on the print job, the print job processing unit 111 determines that the alignment process can be executed at the designated stack unit in S704, and proceeds to the process of S705. The print job processing unit 111 decides on the stack unit designated by the print job as the discharge destination in S705, and proceeds to the process of S708.

On the other hand, if the width of the already-stacked sheets does not match the width of the sheets to be discharged based on the print job, the print job processing unit 111 determines that the alignment process cannot be executed at the designated stack unit in S704, and proceeds to the process of S706. In S706, the print job processing unit 111 determines whether or not the alignment process can be executed at another stack tray that is different from the stack unit designated by the print job. More specifically, as described above, the print job processing unit 111 selects, from among a plurality of stack units that are provided with alignment units (alignment members) and where the alignment process can be executed, another stack unit that is different from the stack unit designated by the print job as a discharge destination for sheets. For example, the discharge destination cannot be changed when the following conditions are both satisfied: sheets are already stacked on all stack units other than the designated stack unit, and none of the widths of these stacked sheets matches the width of sheets designated by the print job. When both of these conditions are satisfied, the print job processing unit 111 determines that the alignment process cannot be executed at another stack tray, and returns to the process of S704. When one of these conditions are not satisfied, the print job processing unit 111 determines that the alignment process can be executed at another stack tray, and proceeds to the process of S707. When returning to the process of S704 from the process of S706, the print job processing unit 111 may notify a user of an instruction to remove the sheets stacked on the stack trays via the operation unit 113 without starting the printing.

The print job processing unit 111 decides on the stack unit selected in S706 as the discharge destination for sheets in S707, and proceeds to the process of S708.

After proceeding to the process of S708 from the process of S705 or S707, the print job processing unit 111 transfers the raster data corresponding to the print job to the image forming unit 112 and instructs the image forming unit 112 to form images on the sheets based on the raster data in S708. Finally, in S709, the print job processing unit 111 causes the image forming unit 112 to convey the sheets on which images have been formed to the discharge unit 115. The print job processing unit 111 also instructs the discharge unit 115 to discharge the sheets conveyed from the image forming unit 112 onto the stack unit corresponding to the discharge destination that was decided on, and to apply the alignment process to the sheets that have been discharged and stacked as a post-process. The print job processing unit 111 then finishes print operations based on the print job.

As described above, in the present embodiment, the printing system 100 includes a plurality of stack units (stack trays) that are each provided with an alignment member for applying an alignment process to sheets. At the time of discharging sheets, when sheets are already stacked on a stack tray that is designated as a discharge destination for sheets that are to be discharged, the printing system 100 determines whether or not the width of the sheets to be discharged matches the width of the already-stacked sheets. When the widths of the sheets do not match, the printing system 100 changes the discharge destination for the sheets to be discharged to another stack tray that is included among the plurality of stack trays and is different from the designated stack tray. The printing system 100 then stacks the sheets on the changed discharge destination and executes an alignment process.

The present embodiment can prevent a reduction in the image quality of already-stacked sheets caused by an alignment process applied to sheets that are newly stacked on a stack tray. Furthermore, as the stacking and alignment processes for the sheets are executed after changing a sheet discharge destination without interrupting a sheet process, the productivity of the sheet process is not reduced.

The above-described first embodiment is advantageous particularly when the width of sheets to be discharged is smaller than the width of sheets that are already stacked on a stack tray designated as a discharge destination for the sheets to be discharged. This is particularly because, when the alignment process is executed after stacking sheets having a small width on already-stacked sheets having a large width, the alignment member comes into contact with the already-stacked sheets during the alignment process.

Conversely, when the alignment process is executed after stacking sheets having a large width on already-stacked sheets having a small width, the alignment member does not come into contact with the already-stacked sheets during the alignment process. However, in this case also, when the alignment process has been applied to the already-stacked sheets, there is a possibility that the aligned state of the already-stacked sheets will degrade due to the alignment process applied to the newly-stacked sheets. For example, there is a possibility that the edge surfaces of the already-stacked sheets will be displaced by the shaking caused by the alignment member coming into and out of contact with the edge surfaces of the newly-stacked sheets. In this case, changing the discharge destination for sheets as in the above-described first embodiment prevents the aligned state of the already-stacked sheets from being degraded.

Second Embodiment

Figure 8:
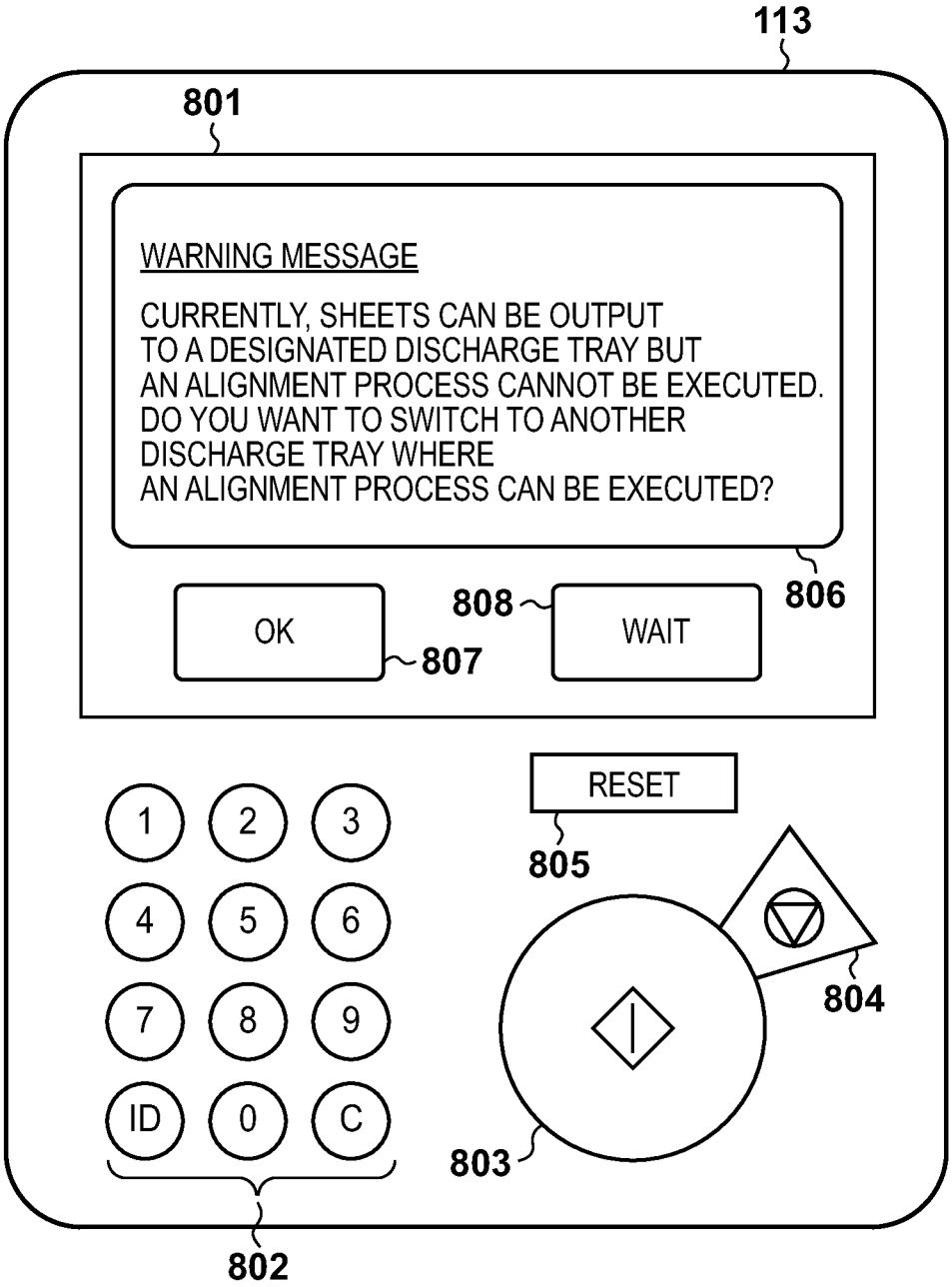
FIG. 8 shows an example of a configuration of an operation unit 113 according to the second embodiment.
Figure 9:
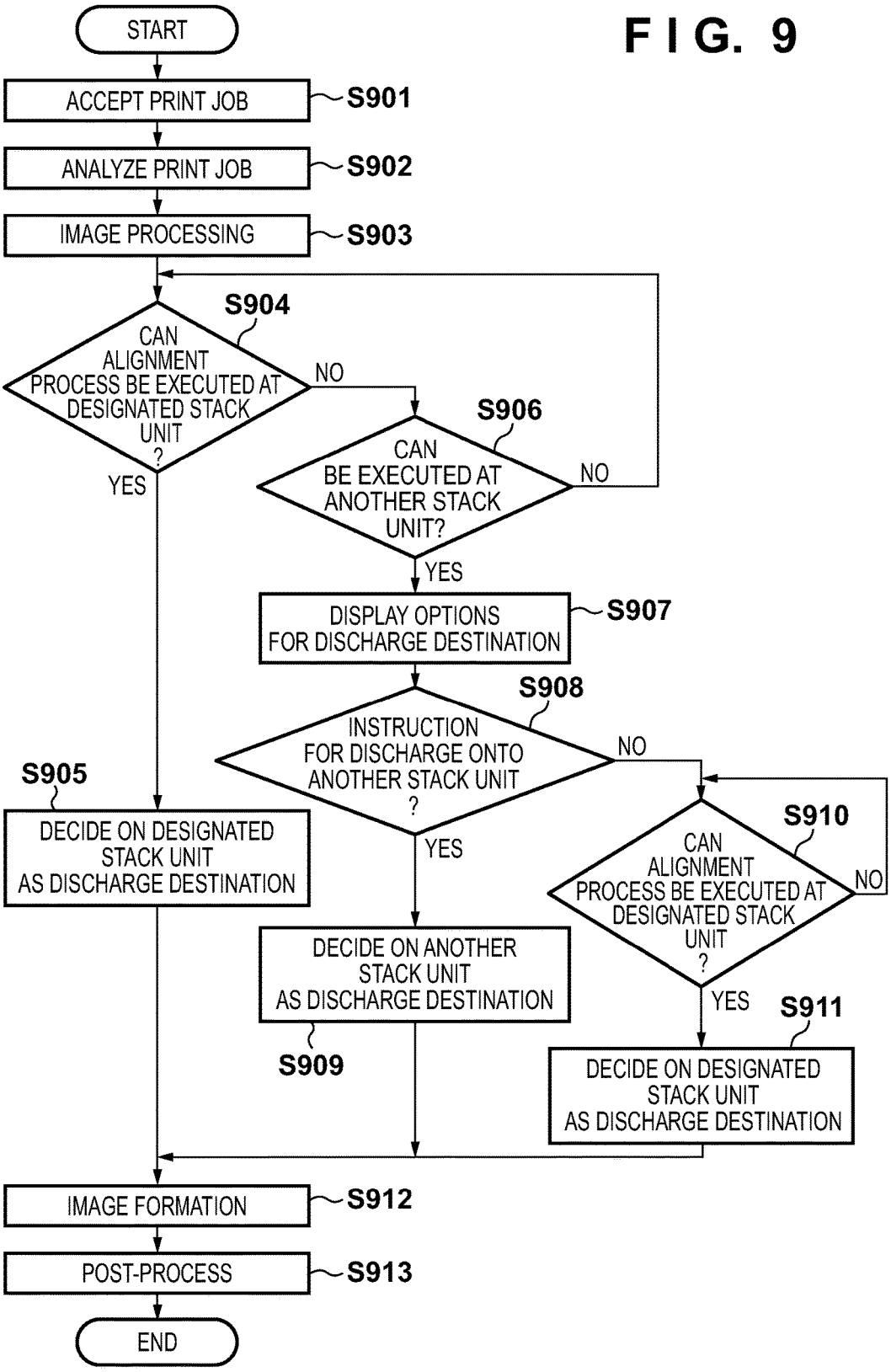
FIG. 9 is a flowchart of a procedure for a sheet process executed by the printing system 100 according to the second embodiment.

A description is now given of the second embodiment of the present invention with reference to FIGS. 8 and 9. It should be noted that the following description has been simplified by omitting a description of portions that are the same as the first embodiment whenever possible.

In general, the setting of a designated discharge destination for sheets in a print job reflects some sort of intention of a creator (user) of the print job. Therefore, there are cases where it is not desirable to automatically change a discharge destination for sheets designated by a print job to another discharge destination in the printing system 100. In such cases, it would be desirable to confirm with the user in advance whether or not the discharge destination for sheets designated by the print job can be changed to another discharge destination.

In the present embodiment, when the width of sheets to be newly discharged does not match the width of sheets that are stacked on a stack unit designated as a discharge destination for the sheets that are to be newly discharged, the print job processing unit 111 accepts, from the user, a selection as to whether or not to change the discharge destination for the sheets to be newly discharged to a different stack unit. This selection is accepted via the operation unit 113. Furthermore, when the user has made the selection to the effect that the discharge destination for the sheets to be newly discharged is changed to a different stack unit, the print job processing unit 111 performs control to change the discharge destination for the sheets to be newly discharged to a different stack unit, stack the sheets on the different stack unit, and execute an alignment process as with the first embodiment. On the other hand, when the user has made the selection to the effect that the discharge destination for the sheets to be newly discharged is not changed to a different stack unit, the print job processing unit 111 performs control to leave the discharge destination unchanged, stack the sheets on the designated stack unit, and execute an alignment process.

First, a description is given of a configuration of the operation unit 113 and a user operation to the operation unit 113 in the present embodiment with reference to FIG. 8. The operation unit 113 includes a display unit 801, input keys 802, a start key 803, a stop key 804, and a reset key 805. In FIG. 8, the display unit 801 displays a warning message 806, an OK button 807, and a wait button 808. The warning message 806 shown in FIG. 8 is displayed on the display unit 801 in the later-described S907 of FIG. 9. In the present embodiment, this warning message 806 is used to prompt the user to select whether or not to change the discharge destination for sheets to a different stack unit. In the present embodiment, the start key 803, the stop key 804 and the reset key 805 are all constituted as hardware keys.

The display unit 801, which is a touchscreen-equipped LCD, is a UI used to, for example, operate and set the printing system 100. The input keys 802 include numeric keys for inputting numeric values, a clear key for deleting input, and the like. The start key 803 is a UI used to issue an instruction for starting print operations. The stop key 804 is a UI used to issue an instruction for interrupting print operations. The reset key 805 is a UI used to issue an instruction for resetting input values and setting values to default values.

<Procedure for Sheet Process by Printing System 100>

The following describes a procedure for a sheet process executed by the printing system 100 according to the present embodiment with reference to FIG. 9. It should be noted that the processes of steps in the flowchart of FIG. 9 are realized in the printing system 100 by the print job processing unit 111 reading programs stored in the storage unit 109 into the RAM 108 and executing the read programs.

First, S901 to S906 are similar to S701 to S706. In the present embodiment, the print job processing unit 111 proceeds to the process of S906 from the process of S904. When the print job processing unit 111 determines in S906 that the alignment process can be executed at another stack tray different from the stack unit designated by the print job, the print job processing unit 111 proceeds to the process of S907. On the other hand, if the print job processing unit 111 determines in S906 that the alignment process cannot be executed at another stack tray different from the stack unit designated by the print job, the print job processing unit 111 returns to the process of S904. When returning to the process of S904, the print job processing unit 111 may notify the user of an instruction to remove the sheets stacked on the stack trays via the operation unit 113 without starting the printing.

In S907, the print job processing unit 111 displays a presentation (warning message 806) related to options for a discharge destination on the operation unit 113. In this way, the print job processing unit 111 prompts the user of the printing system 100 to select a discharge destination for sheets via the operation unit 113. In S907, the warning message 806 is used to prompt the user to select whether to change the discharge destination for sheets to another stack unit that is different from the stack unit designated by the print job and where the alignment process can be executed as determined in S906, or to leave the discharge destination unchanged and discharge sheets to the designated stack unit.

Next, if the print job processing unit 111 determines in S908 that the user has made the selection via the operation unit 113 to the effect that the discharge destination is changed to another stack unit (that is to say, if the OK button 807 has been pressed), the print job processing unit 111 proceeds to the process of S909. As with S707, the print job processing unit 111 decides on the stack unit selected in S906 as the discharge destination for sheets in S909, and proceeds to the process of S708.

On the other hand, if the print job processing unit 111 determines in S908 that the user has made the selection via the operation unit 113 to the effect that the discharge destination is left unchanged and sheets are to be discharged onto the designated stack unit (that is to say, if the wait button 808 has been pressed), the print job processing unit 111 proceeds to the process of S910. In S910, the print job processing unit 111 determines again whether or not the alignment process can be executed at the designated stack unit. In this case, unless the sheets that are already stacked on the designated stack unit are removed, the print job processing unit 111 determines that the alignment process cannot be executed at the designated stack unit and interrupts the execution of the print job. On the other hand, upon removal of the sheets stacked on the designated stack unit, the print job processing unit 111 determines that the alignment process can be executed at the designated stack unit and proceeds to the process of S911.

In S911, the print job processing unit 111 resumes the execution of the print job, and decides on the stack unit designated by the print job directly as the discharge destination as with S705 or S905.

After proceeding to the process of S912 from the process of S905, S909 or S911, the print job processing unit 111 executes the processes that are similar to the processes of S708 and S709 in S912 and S913, respectively.

The present embodiment has described the example where the warning message 806 is displayed on the operation unit 113 to prompt the user to select a discharge destination in S907. The user's selection may be accepted not only via the operation unit 113, but also via the host computer 101 (external apparatus) operated by the user. In this case, in S907, the print job processing unit 111 inquires the host computer 101 that has transmitted the print job as to whether or not to change the discharge destination for sheets to a different stack unit. At this time, it is sufficient for the printer driver 104 in the host computer 101 to display a message similar to the warning message 806 on a display unit of the host computer 101 in response to the inquiry from the print job processing unit 111 in the printing system 100. It is sufficient for the host computer 101 to send, to the printing system 100, a response showing the user's selection accepted via the display unit. The print job processing unit 111 in the printing system 100 accepts the user's selection in accordance with the result of this response. The above method also allows the print job processing unit 111 to accept the user's selection and execute discharge control in accordance with the user's intentions.

As with the first embodiment, the present embodiment can prevent a reduction in the image quality of already-stacked sheets caused by an alignment process applied to sheets that are newly stacked on a stack tray. Furthermore, as the stacking and alignment processes for the sheets are executed after changing a sheet discharge destination without interrupting a sheet process, the productivity of the sheet process is not reduced. The present embodiment further allows the execution of discharge control that reflects the user's intentions.

Other Embodiments

In the example described in the above embodiments, if the width of sheets already stacked on a stack unit designated by a print job does not match the width of sheets to be discharged based on the print job, a determination is made as to whether or not an alignment process can be executed at another stack tray different from the designated stack tray. Alternatively, if the width of the sheets already stacked on the designated stack unit is smaller than the width of the sheets to be discharged based on the print job, the sheets to be discharged based on the print job may be permitted to be stacked on the designated stack unit.

In the example described in the above embodiments, a determination is made as to whether or not the alignment process can be executed at another stack tray different from the designated stack tray, and the discharge destination is not changed when both of the following conditions are satisfied: sheets are already stacked on all of stack trays other than the designated stack tray, and none of the widths of these stacked sheets matches the width of sheets designated by the print job. However, the present invention is not limited in this way. When the width of sheets that are already stacked on another stack tray different from the designated stack tray is smaller than the width of sheets to be discharged based on the print job, the sheets to be discharged based on the print job may be permitted to be stacked on the other stack tray. This makes it even more possible to execute the alignment process for sheets without interrupting the sheet process so as to maintain the image quality of sheets.

In the example described in the above embodiments, the processes shown in FIGS. 7 and 9 are executed when executing a print job. These processes may be executed for each page included in a print job. In this way, a reduction in the image quality of sheets can be suppressed in the case where a print job is composed of a plurality of pages and a sheet for a printed page stacked first has a larger width than a sheet for a printed page stacked next.

In the example described in the above embodiments, whether or not the stack tray is to be changed is controlled based on the difference between the width of sheets already stacked on the stack tray and the width of sheets to be printed. However, the present invention is not limited in this way. Alternatively, whether or not the stack tray is to be changed may be controlled based on information showing the size of sheets already stacked on the stack tray and on information showing the size of sheets to be printed. For example, in the case where the size of the printed sheets already stacked on the stack tray and the size of the sheets to be printed are both A4, control may be performed to leave the stack tray unchanged and stack the sheets to be printed on the stack tray on which the A4 sheets are already stacked. On the other hand, in the case where the size of the printed sheets already stacked on the stack tray is A4R and the size of the sheets to be printed is A4, control may be performed to change the stack tray. In addition, in the case where the size of the printed sheets already stacked on the stack tray is A4 and the size of the sheets to be printed is A5, control may be performed to change the stack tray.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to embodiments, it is to be understood that the invention is not limited to the disclosed embodiments.

This application claims the benefit of Japanese Patent Application No. 2012-243849, filed Nov. 5, 2012, which is hereby incorporated by reference herein in its entirety.

What is claimed is:

1. A sheet processing apparatus comprising:

a first stack tray on which a sheet be stacked;

a second stack tray on which a sheet can be stacked;

alignment members configured to align a sheet stacked on the first stack tray by coming into contact with sides of the sheet stacked on the first stack tray in a width direction perpendicular to a sheet conveyance direction;

a determiner that determines, in a case where the first stack tray is designated as a discharge destination for a first sheet and a second sheet is already stacked on the first stack tray, whether or not a width of the first sheet in the width direction is smaller than a width of the second sheet in the width direction;

a changer that changes the discharge destination for the first sheet from the first stack tray to the second stack tray in accordance with a determination result, by the determiner, indicating that the width of the first sheet is smaller than the width of the second sheet and regardless of a length of the first sheet in the sheet conveyance direction; and a receiver that receives a user operation, wherein, when the receiver receives a user operation indicating that a predetermined option has been selected by a user, the changer does not change the discharge destination regardless of the determination result indicating that the width of the first sheet is smaller than the width of the second sheet.

2. The sheet processing apparatus according to claim 1, further comprising other alignment member configured to align a sheet stacked on the second stack tray by coming into contact with sides of the sheet stacked on the second stack tray;

wherein, in a case where the changer changes the discharge destination for the first sheet from the first stack tray to the second stack tray, the first sheet stacked on the second stack tray is aligned by the other alignment members.

3. The sheet processing apparatus according to claim 1, wherein the second stack tray is a stack tray on which no sheet is stacked or on which a sheet having the same width as the first sheet is stacked.

4. The sheet processing apparatus according to claim 1, wherein, in a case where the changer does not change the discharge destination for the first sheet from the first stack tray to the second stack tray, the first sheet is stacked on the first stack tray after the second sheet is removed from the first stack tray.

5. The sheet processing apparatus according to claim 1, wherein the receiver is configured to display an operation screen for receiving the user operation.

6. The sheet processing apparatus according to claim 5, wherein the operation screen is displayed in the case where the width of the first sheet is smaller than the width of the second sheet.

7. A control method for a sheet processing apparatus including a first stack tray on which a sheet can be stacked, a second stack tray on which a sheet can be stacked and alignment members configured to align a sheet stacked on the first stack tray by coming into contact with sides of the sheet stacked on the first stack tray in a width direction perpendicular to a sheet conveyance direction, the control method comprising:

determining, in a case where the first tack tray is designated as a discharge destination for a first sheet and a second sheet is already stacked on the first stack tray, whether or not a width of the first :sheet in the width direction is smaller than a width of the second sheet in the width direction;

changing the discharge destination for the first sheet from the first stack tray to the second stack tray in accordance with a determination result, by the determination step, indicating the width of the first sheet smaller than the width of the second sheet and regardless of a length of the first sheet in the sheet conveyance direction; and receiving a user operation, wherein, when the received user operation indicates that a predetermined option has been selected by a user, the discharge destination is not changed regardless of the determination result indicating that the width of the first sheet is smaller than the width of the second sheet.

8. A computer-readable storage medium storing a program that, when executed by a sheet processing apparatus including a first stack tray on which a sheet can be stacked, a second stack tray on which a sheet can be stacked and alignment members configured to align a sheet stacked on the first stack tray by coming into contact with sides of the sheet stacked on the first stack tray in a width direction perpendicular to a sheet conveyance direction, causes the sheet processing apparatus to perform a control method comprising:

determining, in a case where the first stack tray is designated as a discharge destination for a first sheet and a second sheet is already stacked on the first stack tray, whether or not a width of the first sheet in the width direction is smaller than a width of the second sheet in the width direction;

changing the discharge destination for the first sheet from the first stack tray to the second stack tray in accordance with a determination result, by the determination step, indicating the width of the first sheet is smaller than the width of the second sheet and regardless of a length of the first sheet in the sheet conveyance direction; and receiving a user operation, wherein, when the received user operation indicates that a predetermined option has been selected by a user, the discharge destination is not changed regardless of the determination result indicating that the width of the first sheet is smaller than the width of the second sheet.

9. A sheet processing apparatus comprising:

a first stacking portion on which a sheet is stacked;

a second stacking portion on which a sheet is stacked;

alignment members configured to align a sheet stacked on the first stacking portion by coming into contact with sides of the sheet stacked on the first stacking portion in a width direction perpendicular to a sheet conveyance direction;

a determiner that determines, in a case where the first stack tray is designated as, a discharge destination for a first sheet and a second sheet is already stacked on the first stacking portion, whether or not a width of the first sheet in the width direction is smaller than a width of the second sheet in the width direction; and a changer that changes the discharge destination for the first sheet from the first stacking portion to the second stacking portion in accordance with a determination result, by the determiner, indicating that the width of the first sheet is smaller than the width of the second sheet and regardless of a length of the first sheet in the sheet conveyance direction.

10. The sheet processing apparatus according to claim 9, wherein the changer changes the discharge destination for the first sheet from the first stacking portion to the second stacking portion in a case where the width of the first sheet is not smaller than the width of the second sheet.

11. The sheet processing apparatus according to claim 9, wherein the changer does not change the discharge destination for the first sheet from the first stacking portion to the second stacking portion in a case where the width of the first sheet is not smaller than the width of the second sheet.

12. The sheet processing apparatus according to claim 9, wherein the second stacking portion is a stack tray on which no sheet is stacked or on which a sheet having the same width as the first sheet is stacked.

13. The sheet processing apparatus according to claim 9, wherein, in a case where the changer does not change the discharge destination for the first sheet from the first stacking portion to the second stacking portion, the first sheet is stacked on the first stacking portion after the second sheet removed from the first stacking portion.

14. The sheet processing apparatus according to claim 9, further comprising second alignment members configured to align a sheet stacked on the second stacking portion by coming into contact with sides of the sheet stacked on the second stacking portion in the width direction of sheet, wherein the second alignment members align the first sheet stacked on the second stacking portion in a case that the changer changes the discharge destination for the first sheet from the fiat stacking portion to the second stacking portion iii accordance with the determination result by the determiner.

* * * * *